US006401507B1

(12) United States Patent
Krcek et al.

(10) Patent No.: US 6,401,507 B1
(45) Date of Patent: Jun. 11, 2002

(54) HYDROFORMING, IN-DIE HYDROPIERCING AND SLUG-EJECTING METHOD AND APPARATUS

(75) Inventors: Glenn Mark Krcek, Sterling Heights; Romuald Gmurowski, Rochester Hills; Bruce Steven Shimanovski, Southfield; Mircea M Ghiran, Lake Orion, all of MI (US)

(73) Assignee: General Motors Corporation, Detroit, MI (US)

( * ) Notice: Subject to any disclaimer, the term of this patent is extended or adjusted under 35 U.S.C. 154(b) by 0 days.

(21) Appl. No.: 09/997,369

(22) Filed: Nov. 30, 2001

(51) Int. Cl.[7] ..... B21D 28/28

(52) U.S. Cl. ..... 72/55; 72/56; 29/421.1; 83/53

(58) Field of Search ..... 72/55, 56; 83/53, 83/177; 29/421.1

(56) References Cited

U.S. PATENT DOCUMENTS 3,487,668 A * 1/1970 Fuchs, Jr. ..... 83/53
5,398,533 A 3/1995 Shimanovski et al. ..... 72/55
5,666,840 A 9/1997 Shah et al. ..... 72/55
5,816,089 A * 10/1998 Marando ..... 72/55
5,996,455 A * 12/1999 Haag et al. ..... 72/55
6,006,566 A * 12/1999 Huelsberg et al. ..... 29/421.1
6,067,830 A * 5/2000 Klages et al. ..... 83/53
6,070,455 A * 6/2000 Cavestri ..... 72/55
6,260,393 B1 * 7/2001 Engel et al. ..... 72/55

* cited by examiner

*Primary Examiner*—David Jones
(74) *Attorney, Agent, or Firm*—Charles E. Leahy

(57) ABSTRACT

A die button flush mounted in the cavity surface of a lower one of two hydroforming dies has a backup plunger received therein that forms a part of this surface when the plunger is in a hydroforming position. A slug ejector received in the lower die also forms a part of this surface and with a tubular part enclosed in the cavity formed by the dies, hydroforming fluid under pressure is supplied to the interior of the part and also to separately act on the plunger. The fluid pressure moves and holds the plunger in its hydroforming position while forming the part to the die cavity surface. The fluid pressure on the plunger is then exhausted allowing the fluid pressure in the part to stretch a portion of the part into the die button while also forcing the plunger to a position that limits this stretching to prevent piercing. The fluid pressure in the part is then reduced to a pressure just sufficient to pierce the stretched portion and the plunger is then allowed to further retract to a position allowing the reduced pressure to pierce a slug onto the plunger. The part is then removed from the die cavity and the plunger is returned to its initial position with the slug thereon where the slug is then ejected from the lower die through an opening in the lower die cavity surface.

9 Claims, 6 Drawing Sheets

HYDROFORMING, IN-DIE HYDROPIERCING AND SLUG-EJECTING METHOD AND APPARATUS

TECHNICAL FIELD

This invention relates to method and apparatus for hydroforming, indie hydropiercing and slug ejecting and more particularly to the manner of hydroforming, in-die hydropiercing and slug ejecting using a die button, backup plunger and slug ejector all mounted in one of two dies that form the hydroforming cavity in which a part is both formed and pierced.

BACKGROUND OF THE INVENTION

Prior to the present invention, it was known to provide in-die hydropiercing and slug-ejecting apparatus as disclosed in U.S. Pat. No. 5,398,533 assigned to the assignee of this invention. In that apparatus, the hydroforming fluid pressure forming the part is also utilized to blowout and thereby pierce a hole in the part with the aid of a die button mounted in the lower one of the two dies forming the hydroforming cavity. And this is accomplished without jeopardizing the hydroforming process and without incurring significant hydroforming fluid leakage. Such apparatus also has provision for ejecting the slug produced from forming the hole.

In the above U.S. Patent, the die button is mounted in the lower die with an outer end flush with the cavity surface of the lower die at the location where the hole is desired in the part. The desired hole shape is circular and for that purpose the die button has a round, centrally located cylindrical piercing hole with a sharp cutting edge at its outer end. The die button is further provided with a cylindrical bore of larger diameter than the piercing hole and immediately below the latter. And a backup plunger is received in the die button bore having an outer end that is initially positioned in a flush position in the piercing hole with respect to the cutting edge of the latter and then in a retracted or piercing position in the bore below the piercing hole by mechanical means in the form of a cam operated mechanism. And an elastomeric seal received on the plunger below its outer end remains in sealing contact with the die button bore during plunger movement to prevent hydroforming fluid leakage past the plunger during piercing.

The lower die is further provided with an ejection chute that is open at one end to the die button bore and at an opposite end exits this die. And the plunger is further retractable to an ejecting position where the above mentioned plunger seal moves past and the outer end of the plunger is located immediately below the opening to the ejection chute.

In the operation of the above apparatus, the dies are closed about the part to be formed and while the upper end of the plunger is held in its flush position in the die button, hydroforming fluid at a high pressure is supplied to the interior of the part forcing it to expand outwardly and conform to the die cavity and the outer end of the plunger. The plunger is then retracted to the piercing position allowing the hydroforming pressure to blow out a slug through and past the cutting edge of the die button and onto the outer end of the plunger where it then rests free of the larger diameter die button bore.

Following the piercing of the slug, the hydroforming fluid is then exhausted from the part and while the dies remain closed about the part, the plunger is then further retracted to its ejecting position where the slug which is resting thereon is ejected by an ejector mechanism onto the ejection chute and slides down by the force of gravity to exit the lower die.

Since the die button has only one cutting edge it must be replaced with wear. Furthermore, the piercing is performed with the hydroforming pressure used to form the part and thus imposes a significant sealing burden on the plunger to prevent leakage there past. Moreover, since the plunger seal must pass over the opening to the ejection chute, such action can cause excessive wear of the seal forcing its early replacement.

SUMMARY OF THE INVENTION

The method and apparatus according to the present invention is a significant improvement over such prior method and apparatus. And in describing the invention, it will be understood that the terms "prepiercing" and "hydroprepiercing" are used herein interchangeably to describe an operation wherein the hydroforming fluid pressure forming the part is utilized to stretch the region in the part to be pierced only partially into a die button without actually piercing or penetrating this region of the part. With the actual piercing then following this operation at a reduced hydroforming fluid pressure to significantly reduce the sealing requirements of the plunger to prevent leakage there past.

With that understanding, the present invention is directed to an in-die hydroprepiercing, hydropiercing and slug-ejecting method wherein a quick change reversible die button insert is fastened to a cylinder fixed in the lower one of two dies that form the die cavity. And a backup plunger is mounted in the fixed cylinder for effecting hydroprepiercing a region of the part, hydropiercing a hole in this thus weakened region, and finally ejecting the slug produced from the piercing. For such purposes, the plunger has a small diameter end portion closely received in the die button, a large diameter end portion located below the lower end of the fixed cylinder and closely received in a moveable cylinder, and an intermediate portion of intermediate diameter closely received in the fixed cylinder. The small diameter end portion of the plunger has an end face that is flush with the die button when the plunger is in a hydroforming/slug-ejecting position determined by the large diameter end portion of the plunger abutting with an adjusting collar that is fastened to and axially adjustable with respect to the moveable cylinder and is abuttable with an inner end of the fixed cylinder. In the plunger hydroforming/slug-ejecting position, the plunger end face together with the outer side of the die button and outer annular edge of the fixed cylinder form an uninterrupted continuation of the die cavity surface in the lower die.

The cylinder in which the large diameter plunger end portion is received is moveable between a hydroforming/prepiercing/slug-ejecting conditioning position and a piercing conditioning position by a hydraulically operated actuator operated with the hydroforming fluid rather than a separate hydraulic power supply. The plunger is moved to and held in its hydroforming/slug-ejecting position during the hydroforming of the part by supplying the hydroforming fluid to the moveable cylinder actuator to extend the moveable cylinder to and hold it in its hydroforming/prepiercing/slug-ejecting conditioning position and also supplying the hydroforming fluid to act on the large diameter plunger end portion to extend and hold the plunger in its hydroforming/slug-ejecting position. While the moveable cylinder remains in its hydroforming/prepiercing/slug-ejecting conditioning position, the pressure in the moveable cylinder is released allowing the plunger to retract to a prepiercing position in the die button by the force of the hydroforming pressure in the part pressing a region of the part outward against the plunger end face and as a result stretching this region of the part partially into the die button and thus weakening this region but not piercing same.

The hydroforming pressure in the part is then reduced to a pressure just sufficient to pierce the weakened region when left unsupported by the plunger. And the plunger is then allowed to further retract to its piercing position in the die button when the moveable cylinder is retracted to its piercing conditioning position by releasing the hydroforming pressure in its actuator. This allows the plunger to again be retracted but now by the force of the reduced hydroforming pressure in the part pressing outward against the plunger end at the previously weakened region and as a result then piercing a slug cleanly from the part and onto the plunger end face to form the desired hole. And because the hydroforming pressure in the part has been significantly reduced for the piercing operation, the hydroforming fluid is less prone to leak past the plunger following the piercing.

A slug ejector is also received in the lower die and is positioned by a hydraulically operated actuator mounted on the lower die. The slug ejector is initially positioned in a hydroforming/slug-ejecting position where the slug ejector abuts with a rigid abutment in the lower die and a face thereof forms a part of the die cavity surface in the lower die. And from this position and following exhausting of the hydroforming fluid from the hydroformed and hydropierced part and removal of the part from the lower die, the slug ejector is moved by its actuator to a slug-retrieving position opposite the outer side of the die button and the plunger end face. The plunger is then returned to its hydroforming/slug-ejecting position with the slug thereon that is then captured by the slug ejector. The slug ejector is then returned to its initial position but now with the slug and the slug ejector then allows the slug to drop onto a chute and exit the lower die by the force of gravity.

Thus, the retracting movement of the plunger end face in the die button to the prepiercing and piercing positions is determined by the moveable cylinder and its attendant hydraulically operated actuator. And the amount of prepiercing can be finely adjusted with the adjusting collar, which is located between the two plunger cylinders.

In a considerably simpler and more compact embodiment, the hydroforming/slug-ejecting position of the backup plunger is determined by the plunger simply abutting with an inner side of the die button on the supply of the hydroforming fluid to act directly on an inner end of the plunger, the prepiercing position is determined by precisely controlling the amount of hydroforming fluid released from directly acting on the plunger, and the piercing position is established by simply exhausting the hydroforming fluid acting directly on the plunger. And thus the positioning of the plunger is effected without an additional plunger cylinder and attendant actuator.

In the present method and apparatus, the slug ejector by being positioned against a rigid abutment during the hydroforming of the part thus eliminates any need for a device such as a cam mechanism to withstand the hydroforming force acting outward through the part on the slug ejector. Furthermore, because the end area of the large diameter end portion of the plunger acted on directly by the hydroforming fluid pressure is substantially larger than the end area of the plunger against which the part is pressed by the hydroforming pressure, the force of the hydroforming pressure acting to hold the plunger in its hydroforming/slug-ejecting position is substantially larger than that acting through the part on the plunger. And thus there is eliminated any need for a device such as a cam mechanism to hold the plunger against the hydroforming force in the part acting outwardly on the plunger. This is quite advantageous recognizing that such a plunger holding device would need to be packaged in the lower die and as a result reduce the strength of this die as well as add significantly to the cost. In addition, there is as earlier mentioned significantly less hydroforming leakage potential at the plunger in that the actual piercing is accomplished with reduced hydroforming fluid pressure in the part.

Further as to the advantages of the present invention, the body of the lower die beneath the die button does not require a slug ejection opening that could substantially reduce the strength of the die in this region. Nor does the plunger require a seal that must pass over an opening to the slug exit chute and suffer excessive wear as a result. Furthermore, the retraction stroke of the slug ejector and the full extension stroke of the plunger provide the slug ejection travel thus eliminating any need for an additional slug-ejecting stroke by the plunger.

In addition, the high water based liquid solution normally used in the hydroforming of the part is also utilized to effect the forced plunger positions thus eliminating any need for an additional hydraulic power supply to perform these functions. And by utilizing the hydroforming fluid to establish the plunger in both its prepiercing and piercing positions, there is prevented premature piercing of the part such as could result from using a separate hydraulic power supply to operate the plunger.

Moreover, the prepiercing can be optimized during tryout to provide a highly reliable and repeatable process for high volume production. In addition, when the die button wears at one of its cutting edges, it can be simply turned over and reattached to the fixed plunger cylinder to present a sharp fresh cutting edge and eventually with wear of the latter cutting edge, the die button can simply be replaced with a new one. In addition, the pierced hole may have various shapes such as circular and flat sided or some other desired shape with the die button and the end of the backup plunger that is received therein shaped accordingly. Furthermore, there is provided the option of establishing the prepiercing and piercing positions of the plunger with and without a separate plunger movement controlling actuator.

The present invention thus provides for economical, highly reliable, hydropiercing and slug ejecting on a high volume production line. For example, producing various parts for a motor vehicle.

It is therefore an object of the present invention to provide a new and improved method and apparatus for in-die piercing and slug ejecting in a hydroforming process.

Another object of the present invention to provide an economical and highly efficient and reliable manner of in-die hydropiercing and slug ejecting wherein the piercing is partially accomplished in one stage during the hydroforming of the part and is finished in a final stage with reduced hydroforming fluid pressure.

These and other objects, advantages and features of the present invention will become more apparent to those skilled in this technical field from the accompanying drawings and following detailed description.

DESCRIPTION OF EXEMPLARY EMBODIMENTS

Figure 1:
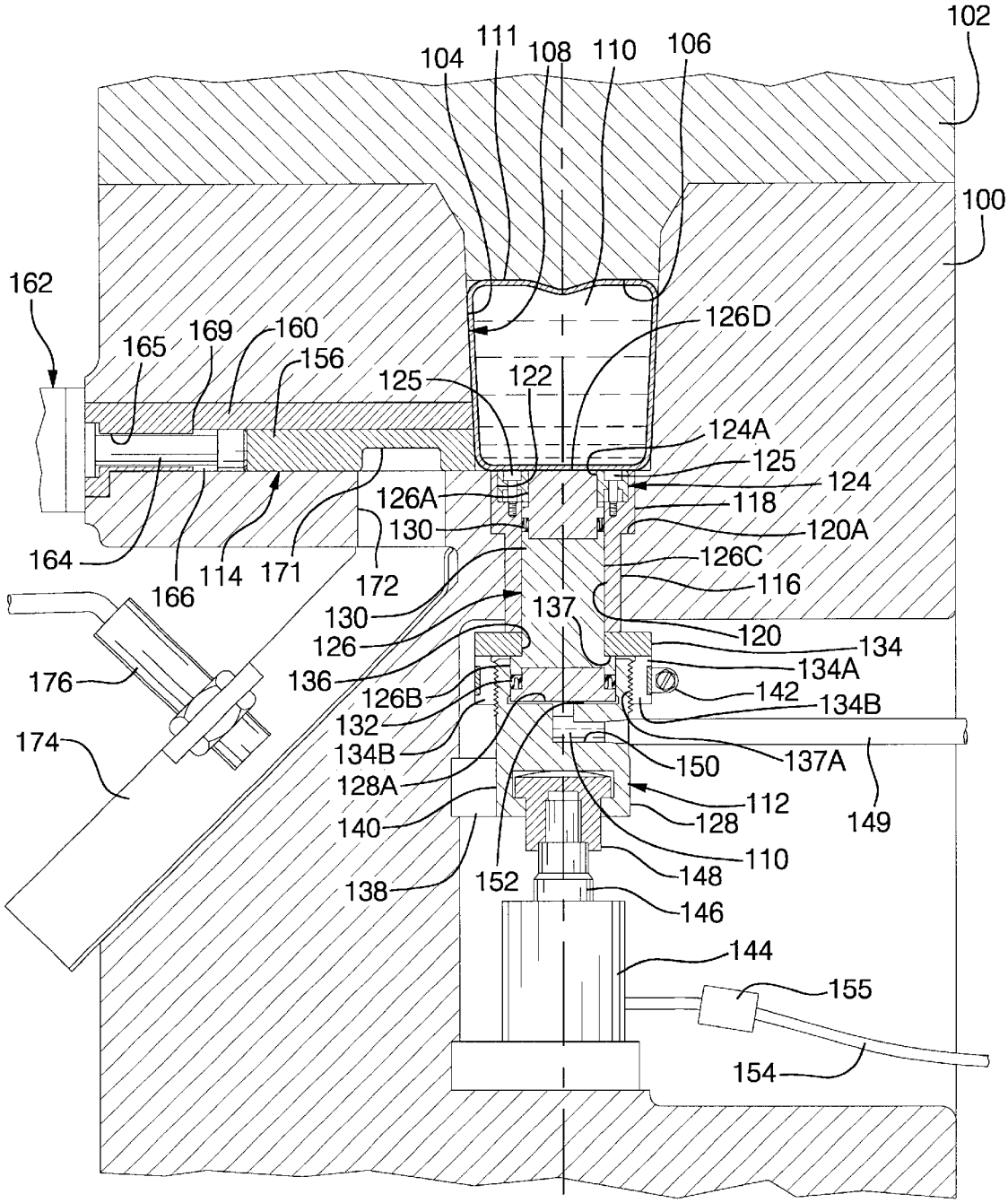
FIG. 1 is a view mainly in transverse cross-section of hydroforming apparatus embodying one preferred form of the in-die hydropiercing and slug ejecting apparatus according to the present invention and wherein the backup plunger is shown in its hydroforming/slug-ejecting position and the plunger's moveable cylinder is shown in its hydroforming/prepiercing/slug-ejecting conditioning position and wherein hydroforming of the part but not prepiercing has occurred.

Referring to the embodiment in FIGS. 1–6 in the drawings, there is shown a conventional form of hydroforming apparatus comprising a lower die 100 and an upper die 102 with surfaces 104 and 106, respectively. With die surfaces 104 and 106 cooperatively forming a die cavity 108 for enclosing a tubular metal part to be formed when the dies are pressed together at their mating surfaces and about the part by suitable conventional press means (not shown). Hydroforming of the part is accomplished in a conventional well known manner using a hydroforming fluid 110 such as a high water based liquid solution that is supplied to the interior of the part via suitable conventional seal units (not shown) that sealing engage the open ends of the part. This fluid supply being maintained to continuously fill the part while the fluid is pressurized sufficiently to form the part to the die cavity resulting in a hydroformed part 111 as shown.

In the case where no hydropiercing is performed, the fluid is exhausted from the part, the seal units are then disengaged from the part, and the die press means is then operated to raise the upper die off the lower die to permit removal of the finished part. In the present case, at least one pierced hole of a particular shape is desired in the part and that is the matter to which the present invention is addressed and in an in-die hydropiercing and slug-ejecting manner. And this is accomplished with a prepiercing/piercing/slug-extracting mechanism and a slug-ejecting mechanism generally designated as 112 and 114, respectively.

The prepiercing/piercing/slug-extracting mechanism 112 comprises a cylinder 116 with a radially outwardly extending annular collar 118 at its upper end that is pressed and thereby fixed in a stepped bore 120 in the lower die 100 in a location directly opposite where the hole is desired in the formed part 111. The cylinder collar 118 abuts with an annular step 120A in the bore 120 to accurately locate the cylinder 116 axially in this bore so that the outer annular end surface of the collar is flush with a bottom region of the surrounding lower die surface 104. The cylinder 116 has a counter-bore 122 in its upper end within the region of the collar 118 that is formed to a precise depth so as to receive a cylindrical die button 124 in a bottoming position on the counter bore step 122A and locate the upper or outer side of the die button flush with the surrounding upper end surface of the collar. See FIG. 4. The die button 124 is a cylindrical quick-change reversible die button insert with identical parallel sides and is fastened to the counter bore step 122A with cap screws 125. The cap screw heads being receivable in a flush manner from both sides of the die button insert in holes extending through the insert and wherein these holes are counter-bored at both ends for this purpose.

The desired hole in the part is circular and for that reason the die button simply has a central, cylindrical piercing hole 124A with the appropriate diameter and sharp edges at both sides of the die button. And it will be understood that the hole to be pierced may be of some other shape with the die button 124 and the backup plunger described below adapted accordingly.

Prepiercing, piercing and slug ejection is accomplished with a backup plunger 126 which is a three-piece assembly as shown and has a small diameter portion 126A at its upper end closely received in the die button piercing hole 124A, a large diameter portion 126B at its lower end closely received in a hydraulically actuated moveable cylinder 128, and a central portion 126C located between and having a diameter intermediate that of the small and large diameter portions 126A and 126B. The central portion 126C of the plunger is closely received in the fixed cylinder 116 and the moveable cylinder 128 has a closed integral lower end 128A and is concentric with and is located below the lower end of the fixed cylinder 116. And elastomeric ring seals 130 and 132 received in annular grooves in the small and large diameter portions 126A and 126B, respectively, contact the respective cylinders 116 and 128 to prevent fluid leakage past these locations.

An adjusting collar 134 is located between the lower end of the fixed cylinder 116 and the upper end of the moveable cylinder 128 and has a central bore 136 which closely receives the central portion 126C of the plunger 126 where this plunger portion extends past the fixed cylinder. The adjusting collar 134 is abuttable with the lower end of the fixed cylinder 116 for the purpose of precisely determining what is referred to as the hydroforming/slug-ejecting position of the plunger 126 shown in FIGS. 1 and 6. Wherein the plunger end face 126D at the upper end of the small diameter plunger portion 126A is located flush with the upper or outer side of the die button 124 when (a) the collar 134 abuts with the fixed cylinder 116, and (b) the plunger is fully extended upward as determined by its large diameter portion 126B abutting with an annular shoulder 137 in the collar 134 on the supply of hydraulic pressure to the lower end of the plunger as described later.

Figure 2:
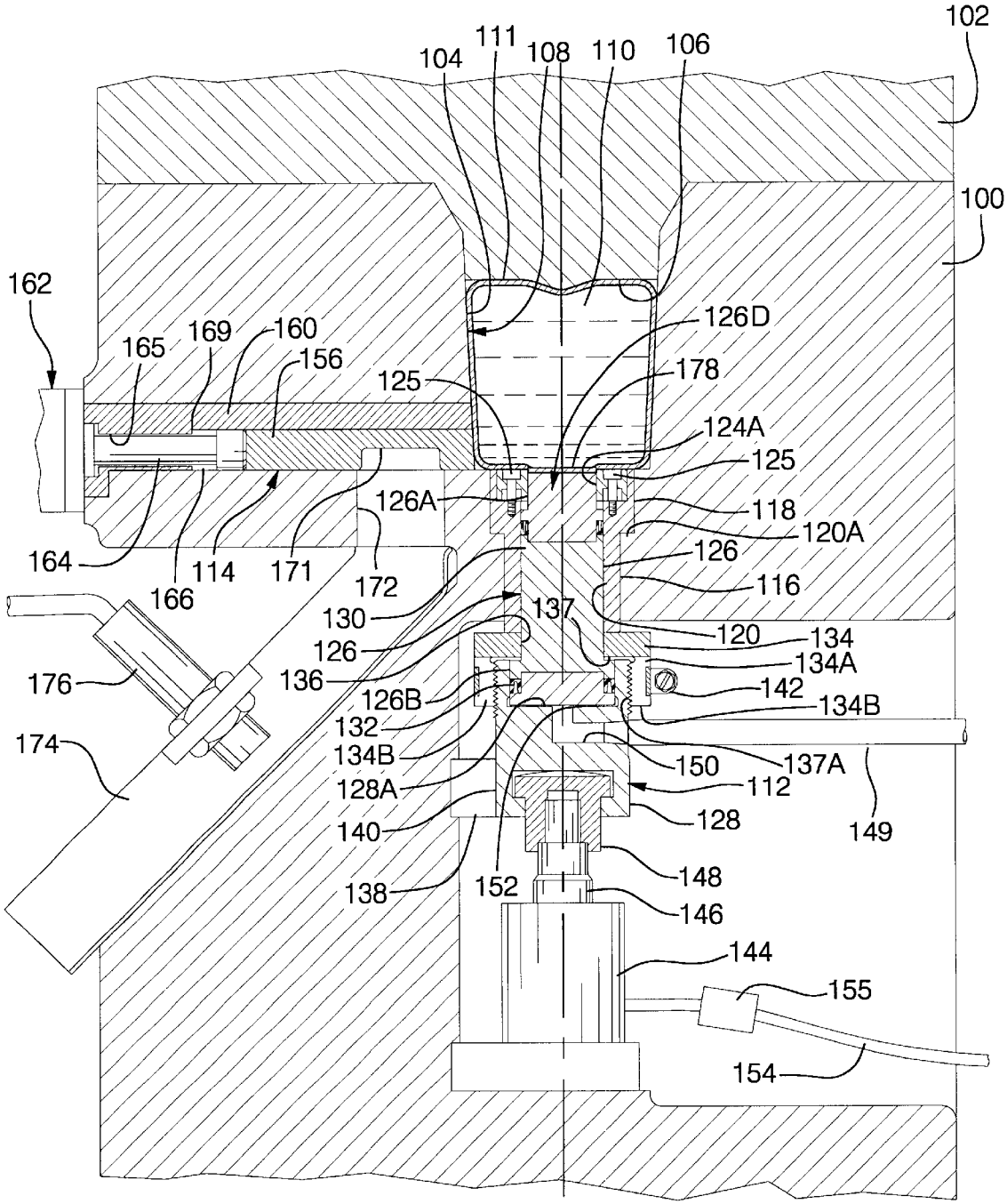
FIG. 2 is a view similar to FIG. 1 but showing the plunger in its prepiercing position and wherein prepiercing has occurred.

A finely adjustable connection between the adjusting collar 134 and the moveable cylinder 128 provides for precise axial adjustment there between and thereby precise adjustable determination of the amount of prepiercing allowed by retractive travel of the plunger 126 when the adjusting collar 134 is held against the fixed cylinder 116 and hydraulic pressure on the lower end of the plunger is exhausted allowing the plunger to bottom in the moveable cylinder as shown in FIG. 2. And this connection is made by providing the adjusting collar 134 with an integral clamping ring portion 134A that has a plurality of circumferentially spaced, axially extending slots 134B and extends over the upper end of the moveable cylinder 128.

The adjusting collar 134 is connected at its slotted clamping ring portion 134A by a threaded connection 137A to an exterior upper end portion of the moveable cylinder 128 wherein such connection has fine threads to provide precise relative axial adjustment there between. For such adjustment, a block 138 fixed to the lower die 100 engages a flat side 140 on the exterior of the moveable cylinder 128 to prevent the latter from turning while the adjusting collar is turned to adjust their axial relationship. After the desired adjustment has been made, a ring clamp 142 on the slotted clamping ring portion 134A of the adjusting collar 134 is tightened to lock the adjusting collar to the moveable cylinder.

Positioning of the moveable cylinder 128 is provided by a hydraulically operated actuator 144 of a suitable conventional type that is mounted in the lower die 100 below the moveable cylinder 128 and has a piston rod 146 extending upward there from. And the moveable cylinder 128 is connected at its lower end to the piston rod 146 by a floating coupler 148 whereby limited relative movement or float is allowed in this connection.

Operation of the plunger 126 is provided by a hydroforming fluid hydraulic line 149 that is connected to a passage 150 in the closed lower end of the moveable cylinder 128 and supplies the hydroforming fluid 110 used to form. the part via this passage to a narrow chamber 152 (see FIG. 1) at the lower end of the plunger for the purpose of extending the plunger to its hydroforming/slug-ejecting position and subsequently provides for exhausting this fluid from this chamber to allow retraction of the plunger to its piercing position as described in greater detail later.

Operation of the moveable cylinder actuator 144 is provided by another hydroforming fluid hydraulic line 154. The hydraulic line 154 is connected to supply the hydroforming fluid 110 to the actuator 144 to extend the moveable cylinder 128 to a hydroforming/prepiercing/slug-retrieving conditioning position shown in FIGS. 1 and 2 and subsequently exhaust this fluid from the actuator 144 to allow the moveable cylinder to retract to a piercing conditioning position shown in FIG. 3.

Sensing of a successful piercing is provided by a pressure-sensing switch 155 of a suitable conventional type that is connected in the hydraulic line 154 to the moveable cylinder actuator 144. The pressure sensing switch 155 is operable to sense a pressure spike in the hydraulic line 154 when a slug is pierced and forced by the hydroforming pressure onto the plunger as the latter is allowed to retract to its piercing position with the exhausting of the hydroforming fluid from the actuator 144. The presence of a substantial pressure spike detects that a successful piercing operation has occurred and signals that a slug is ready for retrieval and ejection. Alternatively, the absence of such a pressure spike signals a warning that appropriate action needs to be taken to cure the problem.

Describing now the slug ejecting mechanism 114 and with particular reference to FIGS. 1 and 4–6, a rectangular slug ejector 156 is closely mounted for guided sliding movement in a rectangular pocket 158 in an insert 160 that forms a part of the lower die 100, the die insert providing for ease in machining the pocket 158. The pocket 158 is open at an outer end at one side of the lower die cavity surface 104 and is oriented to align with the space directly above the upper or outer side of the die button 124.

The slug ejector 156 is connected to a hydraulically operated actuator 162 of a suitable conventional type that is mounted on a side of the lower die 100 and has a piston rod 164 extending through a bore 165 in the die insert 160 at a flat inner end 166 of the pocket 158. And the slug ejector 156 is connected by a floating coupler 167 to the end of the rod 164 whereby limited relative movement or float is allowed in this connection. The other end of the slug ejector 156 is provided with a face 168 and when the slug ejector is in its fully retracted or hydroforming/slug-ejecting position as determined by flat inner ends 169 of the slug ejector abutting with the flat inner end 166 of the pocket 158 as shown in FIGS. 1–3 and 6, this end face forms an uninterrupted continuation of the lower die surface 104.

Figure 4:
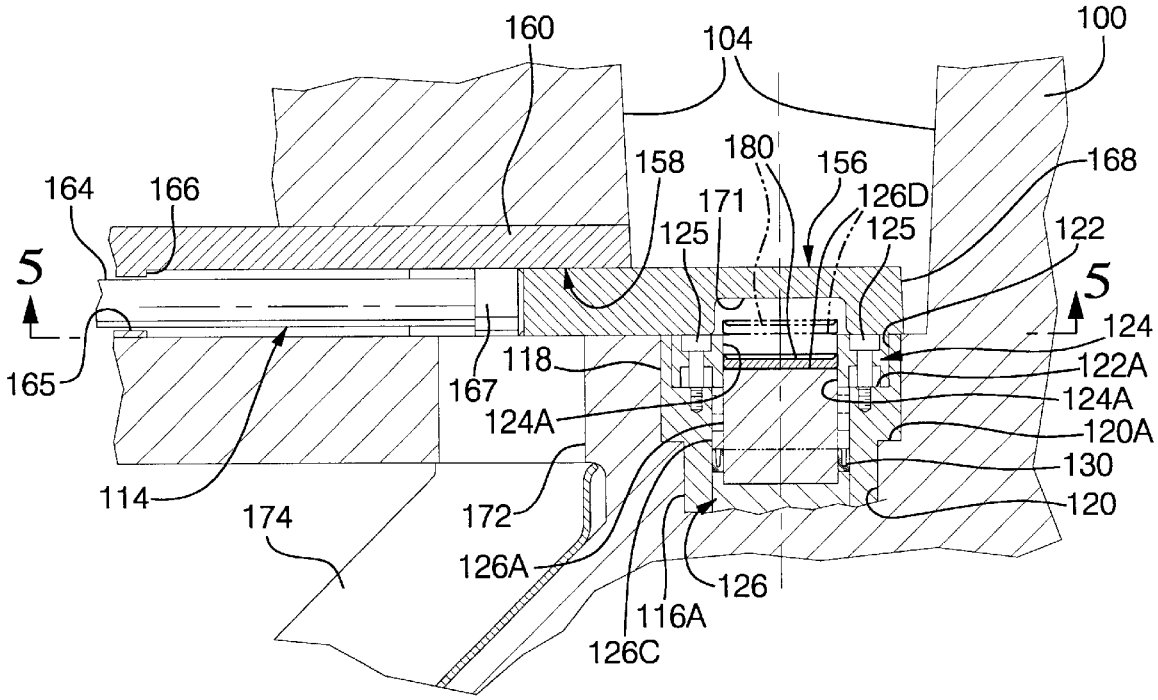
FIG. 4 is a an enlarged view of a portion of FIG. 3 but showing the upper die and hydroformed part removed and the slug ejector in its slug retrieving position and wherein slug retrieval is occurring.
Figure 5:
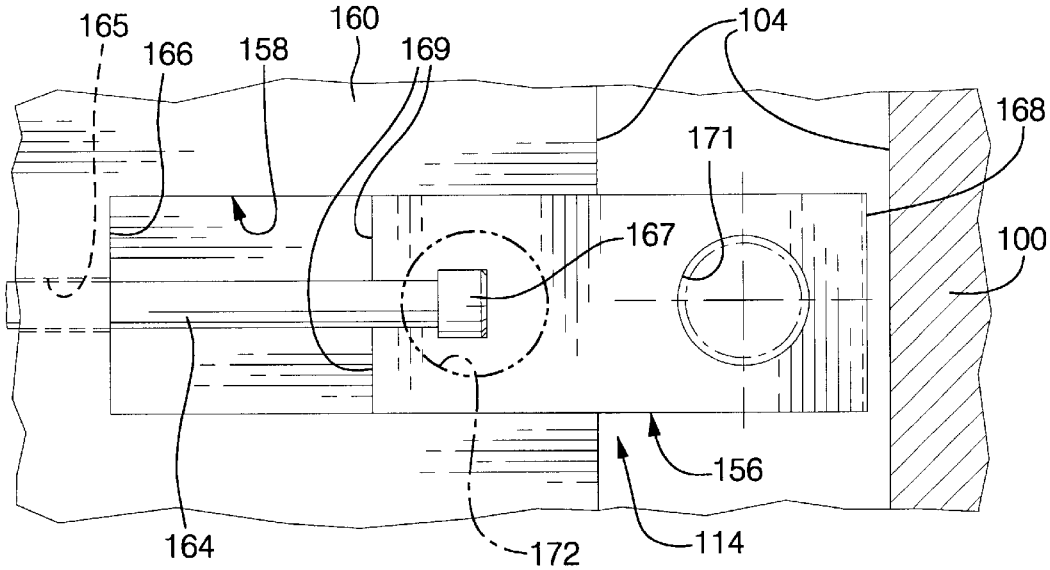
FIG. 5 is a view taken along the line 5—5 in FIG. 4 when looking in the direction of the arrows.

The slug ejector 156 is moveable by the actuator 162 to a slug retrieving position as shown in FIGS. 4 and 5 where it is positioned over the die button 124 with its lower side in close proximity to the upper side of the die button and with a slug trapping cavity 171 in its lower side then directly over the piercing hole 124A in the die button. Alternatively, when the slug ejector 156 is moved by its actuator 162 to its hydroforming/slug-ejecting position shown in FIG. 6, the slug trapping cavity 171 is located over an opening 172 in the lower die 100 directly above an angled chute 174 that is mounted in an accommodating space in the lower die 100 and terminates outside the lower die.

A proximity sensor 176 of a suitable conventional type is mounted in the lower die above the chute 174 and is operable to detect a successful slug ejection by sensing the passage of a slug there past. On such detection, the sensor 176 signals that the apparatus is ready to receive another part for processing. Alternatively, if the sensor 176 does not detect the passage of a slug down the chute, it signals a warning that appropriate action needs to be taken to cure the problem.

Describing now the complete sequential operation of the above apparatus including its setup, the slug ejector 156 is initially positioned in its hydroforming/slug-ejecting position by its actuator 162 and with the dies 100 and 102 apart, a tubular part to be formed is located in the lower die. The part may for example in its original form have a round cylindrical shape along its length or it may be preformed to some predetermined degree so as to fit without any attendant problems in the dies during their closure. With the part in place, the dies are then pressed together to form the die cavity 108 thereabout and the hydroforming fluid 110 is supplied to the interior of the part in a conventional manner and also to both the plunger chamber 152 and the moveable cylinder actuator 144.

The hydroforming fluid is pressurized to a sufficiently high degree and continuously supplied to form the part 111 in a conventional manner to the cross-sectional shape shown in FIG. 1 while positioning and holding the backup plunger 126 in its hydroforming/slug-ejecting position and the moveable cylinder 128 in a fully extended position determined by the adjusting collar 134 abutting against the lower end of the fixed cylinder 116 as also shown in FIG. 1. This position of the moveable cylinder also being referred to as its hydroforming/prepiercing/slug-ejecting conditioning position in view of the operations performed while in this position.

Following the hydroforming of the part, the plunger chamber 152 is exhausted of hydroforming fluid allowing the hydroforming pressure in the part to stretch that region or portion 178 of the part against the plunger end face 126D outward and into the die button piecing hole 124A while forcing the plunger to its prepiercing position shown in FIG. 2 where the plunger bottoms in the moveable cylinder 128 and further stretching is then prevented to prevent penetration of the part.

Assuming this is the first part to be processed, an adjustment of the adjusting collar 134 on the moveable cylinder 128 is made during the setup of the apparatus to approximate the desired amount of prepiercing allowed to occur when the plunger 126 is allowed to move to its prepiercing position. And it will be recalled that this limited prepiercing travel of the plunger 126 corresponds to the relative axial movement allowed between the plunger 126 and the moveable cylinder 128 when the adjusting collar 134 is held against the lower end of the fixed cylinder 116 by the moveable cylinder actuator 144 and the plunger chamber 152 is exhausted. And such prepiercing plunger travel can be simply adjusted as need be by turning the adjusting collar 134 in either direction until the desired amount of prepiercing without penetration is achieved.

The limited prepiercing plunger travel in the die button piercing hole 124A is preferably about half the thickness of the part being formed as shown in FIG. 2 as this has been found to provide for significant stretching and thus significant weakening of the region of the part to be pierced while assuring that no actual piercing or penetration occurs. As such penetration at this point would allow the hydroforming fluid at the high pressure required to form the part to escape to and possibly leak past the plunger.

Figure 3:
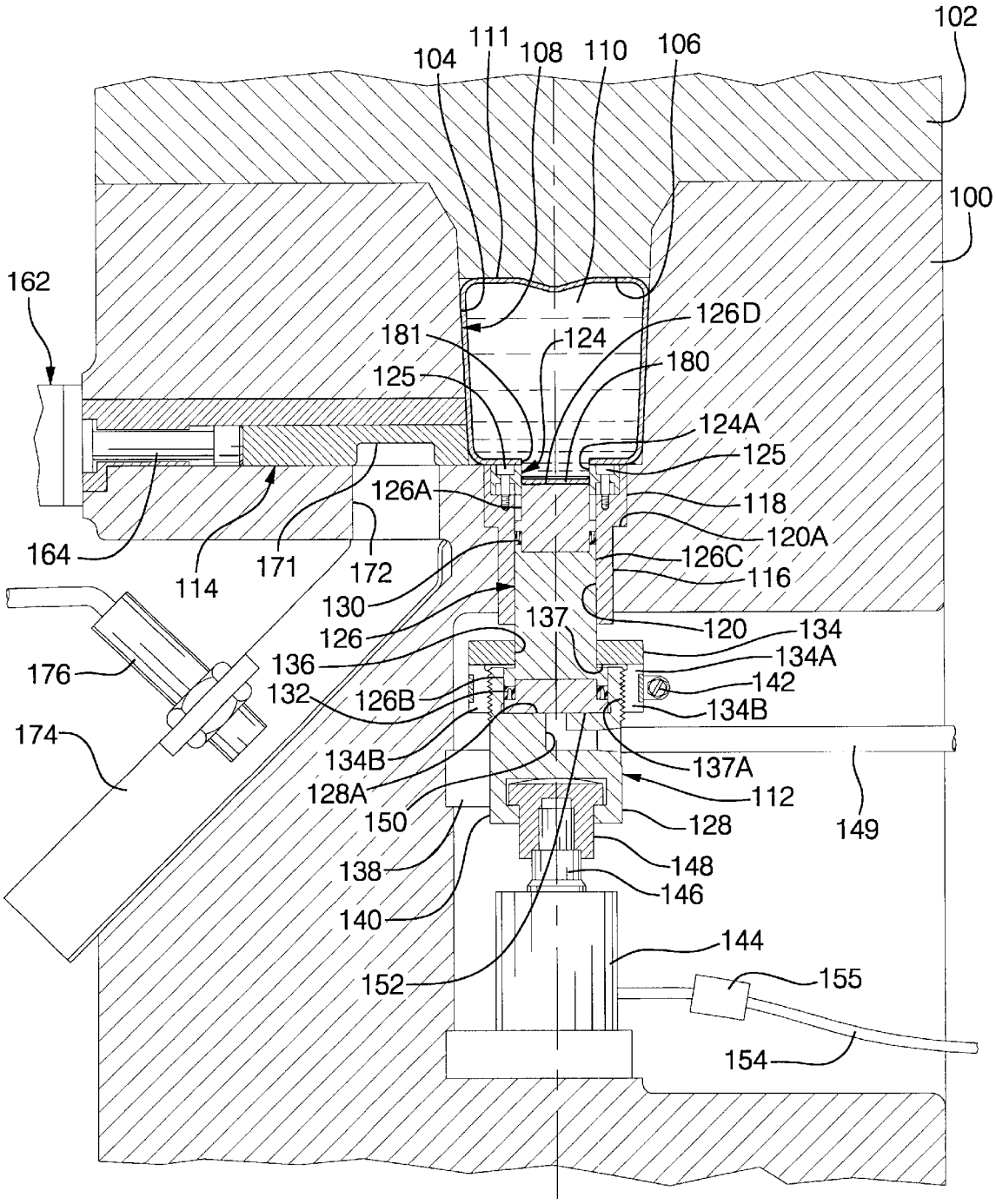
FIG. 3 is a view similar to FIG. 2 but showing the plunger and its moveable cylinder with the attached adjusting collar in their piercing position and wherein piercing has occurred.

Following the prepiercing operation, the pressure of the hydroforming fluid in the part is reduced to a pressure just sufficient to pierce the stretched and thus substantially weakened portion 178. With such reduced pressure thus being significantly lower than that required to form the part and thus less likely to leak past the plunger 126 when the weakened portion is pierced. The moveable cylinder actuator 144 is then exhausted of hydroforming fluid allowing the moveable cylinder 128 to fully retract to its piercing conditioning position shown in FIG. 3 and thereby allowing the plunger 126 to further retract to its piercing position as also shown in FIG. 3 by the force of the reduced hydroforming fluid further stretching the weakened prepierced portion 178 into the die button piercing hole 124A and finally piercing a slug 180 from the part and onto the plunger end face 126D to form a hole 181 in the part.

With a successful hole piercing being sensed by the pressure-sensing switch 155, the latter then signals that a slug is ready for ejection. Following the successful hydroforming and hydropiercing of the part, the hydroforming fluid is exhausted from the formed and pierced part 111, the seal units are disengaged there from, the upper die 102 is lifted off the lower die 100 and the finished part is then removed from the latter die as shown in FIGS. 4 and 5.

Figure 6:
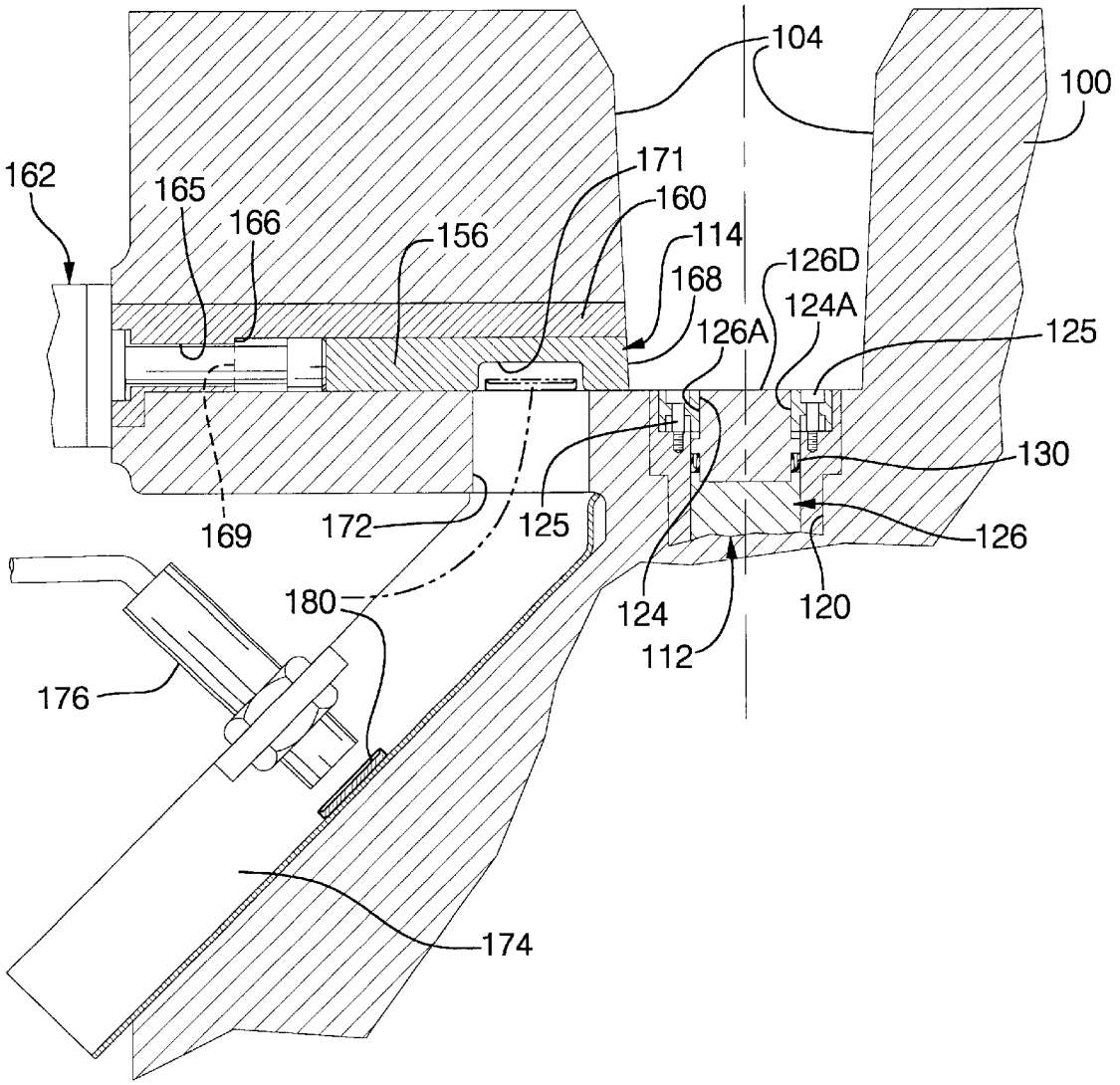
FIG. 6 is a view similar to FIG. 4 but showing the slug ejector in its hydroforming/slug-ejecting position ejecting a pierced slug.

The slug ejector 156 is then extended by its actuator 162 to its slug retrieving position opposite the slug 180 as shown in FIG. 4. And the plunger 126 with the slug 180 thereon is then returned to its hydroforming/slug-ejecting position in the manner described previously as also shown in FIG. 4 whereby the slug is then positioned in and trapped by the cavity 171 in the slug ejector and wherein both the plunger and slug are shown in phantom lines in this view to illustrate these operations. The slug ejector 156 is then retracted to its hydroforming/slug-ejecting position in the lower die as shown in FIG. 6 where the slug 180 drops from the position shown in phantom lines onto the chute 174 and then slides down the chute as illustrated in solid lines in this view and eventually exits the lower die by the force of gravity. And in passing down the chute, the sensor 176 senses a successful slug ejection and sends a signal that the apparatus is ready to process another part.

Figure 7:
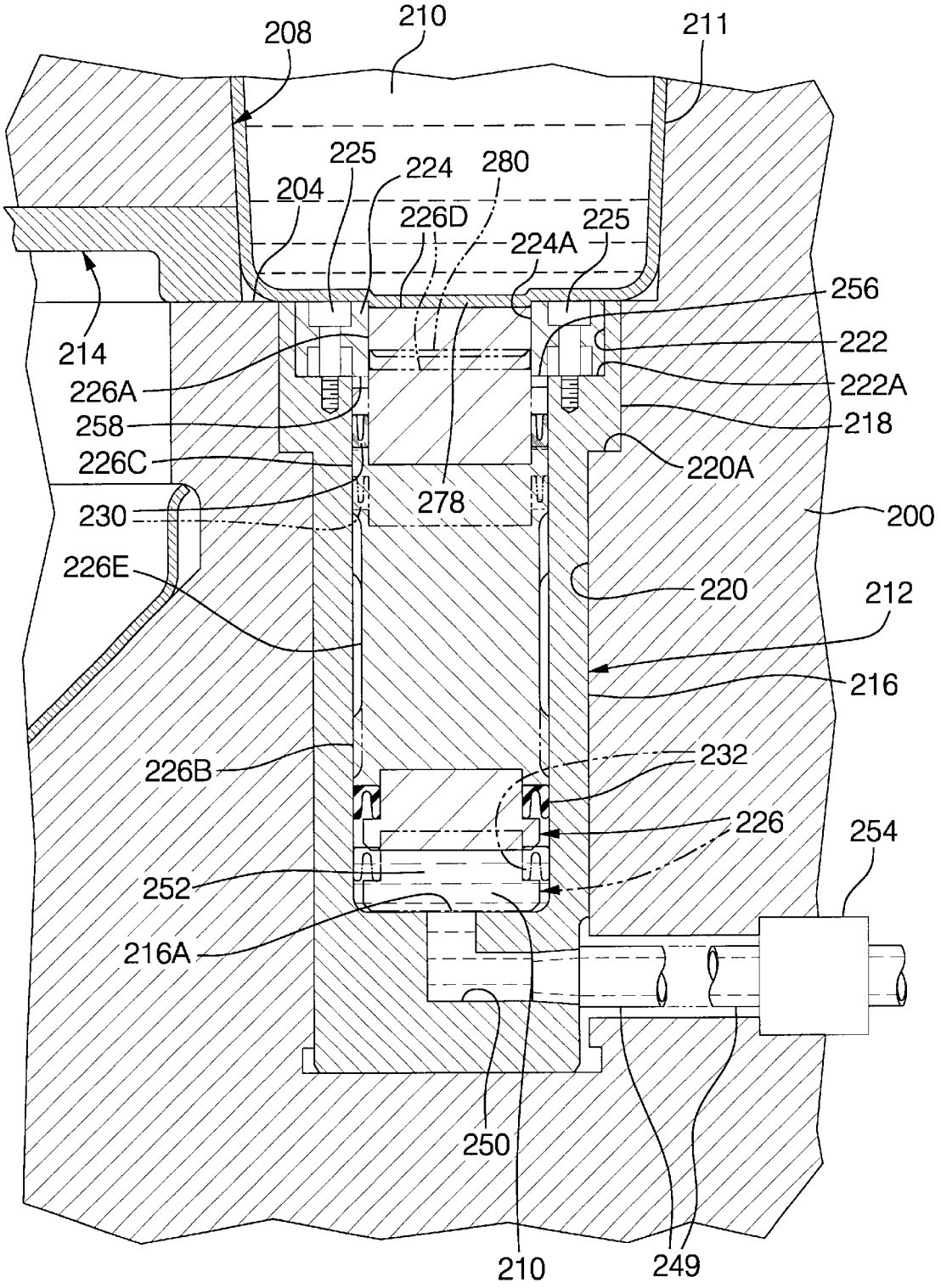
FIG. 7 is a cross-sectional view of another embodiment of the hydropiercing and slug-ejecting apparatus according to the present invention.

Referring now to FIG. 7, there is shown a simplified form of the prepiercing/piercing/slug-extracting mechanism according to the present invention as embodied in hydroforming apparatus like that previously described in detail wherein there is a lower die 200 and an upper die (not shown) defining a die cavity 208 for forming a part 211 (like part 111) and wherein there is a slug ejecting mechanism 214 (like mechanism 114) for retrieving and ejecting a slug following piercing.

In its simplified form, the prepiercing/piercing/slug extracting mechanism which is generally designated as 212 in this embodiment comprises a cylinder 216 with an annular collar 218 at its upper end that is pressed and thereby fixed in a stepped bore 220 in the lower die 200 like in the previous embodiment. And also like in the previous embodiment, the cylinder collar 218 abuts with an annular step 220A in the bore 220 to accurately locate the cylinder 216 axially in this bore so that the upper annular end surface of the collar is flush with the surrounding lower die surface 204. Also like in the previous embodiment, the cylinder 216 has a counter-bore 222 in its upper end within the region of the collar 218 that is formed to a precise depth so as to receive a die button 224 in a bottoming position on the counter bore step 222A and locate the upper or outer side of the die button flush with the surrounding upper end surface of the collar 218. And again, the die button 224 is in the form of a quick-change reversible die button insert the same as that in the previous embodiment and is fastened to the counter bore step 222A with recessed cap screws 225.

Unlike the previous embodiment, the fixed cylinder 216 has an integral closed lower end 216A and prepiercing, piercing and slug ejection is accomplished all with direct operation of a backup plunger 226 having a small diameter portion 226A at its upper end closely received in the die button piercing hole 224A, a large diameter portion 226B at its lower end closely received in the cylinder 216, and an intermediate portion 226C adjoining the small diameter portion 226A having the same diameter as the large diameter portion 226B and also being closely received in the cylinder 216. With the plunger 226 also being further formed with an intermediate necked or relieved portion 226E between the two large diameter portions 226B and 226C. The plunger 226 is again a three-piece assembly on which elastomeric ring seals 230 and 232 are received in annular grooves in the plunger but in this embodiment in the equally large diameter plunger portions 226C and 226B, respectively, and both engage the cylinder 216 to prevent fluid leakage past these locations.

Operation of the plunger 226 is provided by a hydroforming fluid hydraulic line 249 that is connected by a passage 250 to a chamber 252 below the plunger at the closed lower end 216A of the fixed cylinder 216 and supplies the hydroforming fluid 210 used to form the part to the chamber 252 and also provides for exhausting the fluid from this chamber. And controlled supply and exhaust of the hydroforming fluid with respect to the chamber 252 as will now be described is provided by a suitable programmable electronic control system 254 connected in the hydraulic line 249.

Recalling the previously described positions of the backup plunger 126 in the FIG. 1 embodiment, the small diameter portion 226A of the plunger 226 in the embodiment shown in FIG. 7 is now provided with a precise hydroforming stop determining axial dimension or length. Such that the plunger 226 is moved to its hydroforming/slug-ejecting position by simply supplying the hydroforming fluid to the chamber 252 causing the plunger 226 to extend upward until the upper annular shoulder 256 of its large diameter portion 226C abuts with the lower annular side 258 of the die button 224. The die button 224 thus serving as a stop for the plunger 226 in determining the latter's hydroforming/slug-ejecting position.

Following the hydroforming of the part, the control system 254 is programmed to precisely regulate the release of a certain volume of the hydroforming fluid 210 from the chamber 252. Such regulated fluid release being determined to correspond exactly to the desired prepiercing plunger travel. And thus allowing the plunger 226 to retract to and be held in its prepiercing position by the reduced hydroforming fluid volume in the chamber 252 as the hydroforming fluid pressure in the part stretches a region 278 of the part partially into the die button as shown in solid lines in FIG. 7. The control system is also preferably programmed with a momentary dwell in the prepiercing portion of the overall cycle so as to establish the desired prepierce plunger position by testing and provide verification thereof during apparatus tryout.

Following the prepiercing, the hydroforming fluid pressure in the part is reduced like in the FIG. 1 embodiment for piercing the weakened region 278 pressed against the plunger end face 226D and the remaining hydroforming fluid in the chamber 252 is then exhausted by the control system 254 allowing the plunger 226 to move to its piercing position which is determined by the plunger bottoming on the closed end 216A of cylinder 216 as shown in phantom lines in FIG. 7. And also like before, piercing then occurs with reduced hydroforming pressure in the part resulting in a slug 280 being pierced from the prepierced and thus weakened region 278 and projected onto the plunger end face 226D as shown in phantom lines.

The plunger 226 is then returned to its hydroforming/slug-ejecting position with the slug following opening of the dies and removal of the part 210 from the lower die 200. The slug 280 is then retrieved and ejected from the lower die by the slug ejecting mechanism 214 in the manner described previously with respect to the ejecting mechanism 114. And it will be understood that the successful piercing of the slug 280 and its successful ejection is also sensed and signaled like that in the FIG. 1 embodiment.

The present invention as thus described with exemplary embodiments is intended to disclose and teach the invention and it will be appreciated that other forms of the invention can be readily arrived at by those skilled in this art as a result. Accordingly, the scope of the present invention is intended to be limited only by the scope of the following claims.

What is claimed is:

1. An in-die method of hydropiercing and slug ejecting in the formation of a hole in a hydroformed part comprising the steps of (a) supplying a hydroforming fluid to continuously fill a part while pressuring the fluid sufficiently to stretch the part outward to conform to the surface of a die cavity formed by upper and lower dies and wherein the cavity surface in the lower die includes the end of a plunger and one side of a die button surrounding the end of the plunger while the plunger is held in a first position, (b) allowing the end of the plunger to retract a first predetermined distance into the die button in a hydroprepiercing operation to a second position and thereby allow the hydroforming fluid pressure to stretch a region of the part outward into the die button said first predetermined distance and against the end of the plunger whereby said region is significantly weakened but not pierced, (c) reducing the hydroforming pressure significantly to a pressure at least sufficient to pierce the weakened region on further plunger retraction, (d) allowing the end of the plunger to further retract a second predetermined distance into the die button to a third position and thereby allow the reduced hydroforming fluid pressure to pierce a slug from the weakened region and onto the end of the plunger, (e) exhausting the hydroforming fluid from the part, (f) removing the part from the die cavity, (g) returning the plunger with the slug thereon to the first position, (h) retrieving the slug from the end of the plunger through an opening in the lower die cavity surface to a location within the lower die, and (i) ejecting the slug by the force of gravity from the lower die through an opening in the lower die.

2. A method as defined in claim 1 further comprising the steps of using a quick-change reversible die button insert as the die button, and using. one side of the die button as a stop in determining the first position of the end of the plunger.

3. A method as defined in claim 1 further comprising the steps of supporting the plunger in a moveable cylinder, establishing and holding the end of the plunger in the first position with the hydroforming fluid pressure forming the part and with a hydraulically operated actuator acting on the moveable cylinder operated with the hydroforming fluid pressure forming the part, and establishing and holding the end of the plunger in the second and third positions solely with the hydraulically operated actuator.

4. A method as defined in claim 1 further comprising the steps of holding the end of the plunger in the first position with the hydroforming fluid pressure forming the part, releasing a predetermined amount of the hydroforming fluid acting on the plunger to establish and hold the end of the plunger in the second position, and releasing all the hydroforming fluid acting on the plunger to establish and hold the end of the plunger in the third position.

5. A method as defined in claim 1 further comprising the step of sensing the ejection of the slug from the lower die during the ejection to verify a successful ejection of the slug.

6. A method as defined in claim 1 further comprising the step of establishing the first predetermined distance as about half the thickness of the part.

7. A method as defined in claim 3 further comprising the step of sensing a pressure spike in the hydroforming pressure acting in the hydraulic actuator while the end of the plunger is moving to the third position to verify a successful piercing of the slug.

8. A method as defined in claim 4 further comprising the step of sensing a pressure spike in the hydroforming pressure acting directly on the plunger while the end of the plunger is moving to the third position to verify a successful piercing of the slug.

9. An in-die method of hydropiercing a hole in a hydroformed part comprising the steps of (a) supplying a hydroforming fluid to continuously fill a part while pressuring the fluid sufficiently to stretch the part outward to conform to a die cavity surface wherein the die cavity surface includes the end of a plunger and one side of a die button surrounding the end of the plunger while the plunger is held in a first position, (b) allowing the end of the plunger to retract a first predetermined distance into the die button in a hydroprepiercing operation to a second position and thereby allow the hydroforming fluid pressure to stretch a region of the part outward into the die button said first predetermined distance and against the end of the plunger whereby said region is significantly weakened but not pierced, (c) reducing the hydroforming pressure significantly to a pressure at least sufficient to pierce the weakened region on further plunger retraction, and (d) allowing the end of the plunger to further retract a second predetermined distance into the die button to a third position and thereby allow the reduced hydroforming fluid pressure to pierce a slug from the weakened region and onto the end of the plunger.

* * * * *